United States Patent [19]

Romanski

[11] 4,224,372

[45] Sep. 23, 1980

[54] PAPER MACHINE CLOTHING HAVING CONTROLLED INTERNAL VOID VOLUME

[75] Inventor: Eric R. Romanski, Menands, N.Y.

[73] Assignee: Albany International Corp., Albany, N.Y.

[21] Appl. No.: 973,023

[22] Filed: Dec. 26, 1978

[51] Int. Cl.[2] ..... D03D 13/00

[52] U.S. Cl. ..... 428/257; 28/142; 28/158; 139/383 A; 139/425 A; 156/78; 162/DIG. 1; 428/310

[58] Field of Search ..... 28/142, 158; 139/383 A, 139/425 A; 162/DIG. 1; 428/240, 245, 257, 310, 317; 156/77, 78

[56] References Cited

U.S. PATENT DOCUMENTS

| | | | |
|---|---|---|---|
| 3,059,312 | 10/1962 | Jameeson | 139/383 A |
| 3,090,406 | 5/1963 | Hoppelman et al. | 139/410 |
| 3,523,867 | 8/1970 | MacBean | 139/425 A |
| 3,965,942 | 6/1976 | Hatch | 428/257 |
| 4,090,002 | 5/1978 | Rosenblum | 428/245 |
| 4,144,371 | 3/1979 | Okie et al. | 428/245 |

*Primary Examiner*—James J. Bell

*Attorney, Agent, or Firm*—Kane, Dalsimer, Kane, Sullivan and Kurucz

[57] ABSTRACT

The disclosure is of a fabric adapted as clothing for a papermaking machine. The fabric, which may be made endless, is useful to make dryer felts, wet felts and forming wires. The fabric of the invention comprises a plurality of crosswise yarns disposed in a plurality of separate layers, each layer being on a plane parallel to the crosswise plane of the fabric. A plurality of lengthwise yarns is interwoven with the crosswise yarns and binds the layers of crosswise yarns together to form a multilayer fabric. Structurally, the crosswise yarns in a given layer are separated from the adjacent crosswise yarns in adjacent layers at points along their length by void spaces within the body of the woven fabric. A synthetic, polymeric, thermoplastic resin foam fills, at least partially, the void spaces to control the void volume in the fabric of the invention.

10 Claims, 4 Drawing Figures

PAPER MACHINE CLOTHING HAVING CONTROLLED INTERNAL VOID VOLUME

BACKGROUND OF THE INVENTION

1. Field of the Invention

The invention relates to paper machine clothing useful for fabrication of dryer belts, employed in the dryer section of a papermaking machine, wet belts employed in the press section of such machines and forming wires which may be used on fourdrinier and cylinder machines and more particularly relates to such fabrics having controlled void volumes.

2. Brief Description of the Prior Art

On papermaking machines, endless woven belts are employed in various sections to carry the sheet or web of paper. For example, in the dryer section such belts carry the sheet of paper in close contact with the heated dryer cylinders. There are a wide variety of forms of the endless woven belts, some fabricated from metal and others from textile material such as cotton, cotton and asbestos or cotton, asbestos and synthetic fibrous or filamentous materials. The selection of a given material is dependent to some degree upon the use to which the fabric will be put, i.e.; as a forming fabric, dryer felt, etc. One form of belt commonly employed in the dryer section of a papermaking machine is referred to as a "screen" and is fabricated by weaving synthetic monofilaments or twisted multi-filaments together in an open weave. Although not subjected to any form of milling, and therefore not "felts" in the original sense of the term, these screen fabrics have also become known as "dryer felts". The endless belts are generally woven flat and the ends thereafter joined to form an endless belt. The weave selected may be a two or three layer weave of synthetic yarns such as multifilament, spun or monofilament yarns.

It will be appreciated that the screen type of "dryer felt" fabric is relatively open in design, resulting in a relatively high fabric permeability, i.e.; air permeability on the order of from about 70 to 700 CFM/sq. ft. at ½" water. Such fabrics permit free vapor passage through the fabric during operation of the papermaking machine. In some machines, such a high permeability may not be desirable, although other characteristics of the screen are advantageous. To lower the fabric air permeability in dryer screens it has heretofore been suggested that internal fabric interstices or voids between lengthwise and cross-wise yarns in the multi-layers be at least partially filled with "stuffer picks" or spun yarns; see British Pat. No. 1,207,446. The stuffer picks form internal baffles in the fabric and reduce overall permeability of the fabric. However, the presence of the spun yarn stuffer picks also increases the moisture retention of the fabric. Over a period of time this may reduce the drying efficiency of a given paper machine operation employing this kind of dryer felt.

The dryer felt fabric of the present invention obviates a number of problems associated with prior art dryer fabrics, particularly of the screen type. The fabrics of the invention are characterized by low permeability, i.e.; on the order of from 5 to 300 CFM/sq. ft. at ½" water. However, they do not retain moisture to any significant degree above that observed for screens fabricated without inclusion of "stuffer picks". The fabrics of the invention are advantageously used to fabricate "dryer felts" for papermaking machines.

Although the method of the invention is particularly advantageous for controlling the void volume in dryer felts, it may also be used to control void volume in wet belts, i.e.; true papermaker's felts and in forming wires. Such uses will be discussed more fully hereinafter.

SUMMARY OF THE INVENTION

The invention comprises a paper machine fabric, which comprises:

a plurality of crosswise yarns disposed in a plurality of separate layers, each layer being on a plane parallel to the crosswise plane of the fabric;

a plurality of lengthwise yarns interwoven with the crosswise yarns and binding the layers of crosswise yarns together to form a multi-layered textile fabric;

the crosswise yarns in a given layer being separated from adjacent crosswise yarns in the adjacent layer at points along their length by void spaces within the body of the woven fabric; and a synthetic, polymeric, thermoplastic resin, cellular foam in void spaces.

The terms "foam" and "cellular foam" as used herein means a cellular polymer or cellular plastic.

DETAILED DESCRIPTION OF THE PREFERRED EMBODIMENTS OF THE INVENTION

A complete understanding of the invention may be readily obtained from the following description of the preferred embodiments, read in conjunction with the accompanying drawings of FIGS. 1–4, inclusive.

Figure 1:
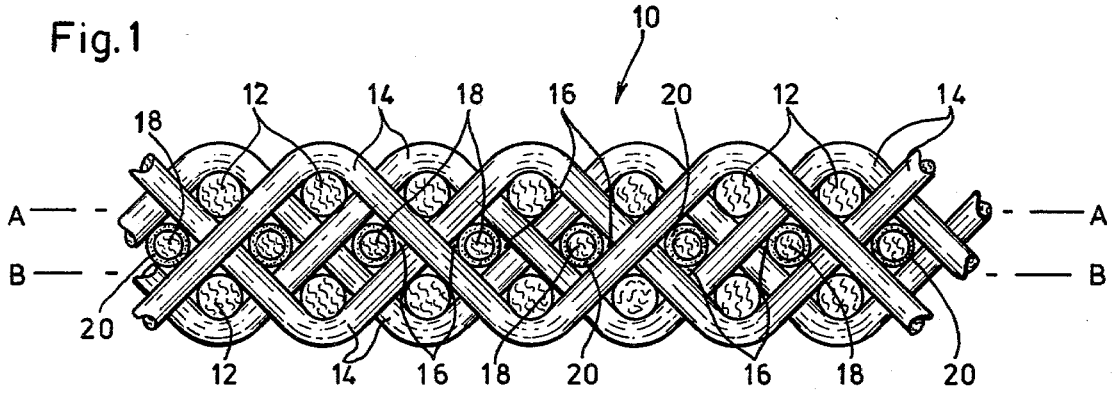
FIG. 1 is an enlarged, cross-sectional, diagrammatic, side elevation of a portion of a precursor to a fabric embodiment of the invention.

FIG. 1 shows diagrammatically a portion of a two and one-half layer precursor dryer felt fabric of the invention, in a cross-sectional side elevation. The fabric 10 comprises a plurality of crosswise yarns 12 disposed in an upper layer A and in a lower layer B. The layers A, B are parallel to the crosswise plane of the fabric 10 (crosswise to the machine direction of felt travel during use). The crosswise yarns 12 and the layers A and B are bound together by the interwoven lengthwise yarns 14. The yarns 12, 14 may be monofilament, multi-filament or spun yarns of any conventional denier. Preferably for a dryer felt, low absorption monofilament yarns are employed. Representative of preferred monofilament yarns 12, 14 are monofilament yarns of polyesters, polyamides, polyaramids, polyolefins and the like which do not absorb high proportions of moisture. Preferably the monofilaments will have a diameter of from about 0.008 to 0.04 inches to provide a high degree of stability and structural integrity in the fabric of the invention.

It will be observed from FIG. 1 that there are a plurality of interstices or voids 16 among the layers A, B separating adjacent crosswise yarns 12 at select points along the length of the crosswise yarns 12. These voids 16 are open areas within the body of fabric 10 which permit unimpeded flow of air through the fabric 10, accounting in part for the high permeability associated with these screen types of fabric. In the fabric 10, the voids 16 are partially filled with stuffer pick yarns 18 which act as fillers and are disposed in the crosswise plane of the fabric 10, substantially parallel to the crosswise yarns 12. The nature of the stuffer pick yarns 18 is not critical and a wide variety of yarns may be employed, of a dimension suitable for partially filling the voids 16 without expanding the thickness of the fabric 10. Representative of yarns which may be employed as the yarns 18 are monofilament, spun and multi-filament yarns of synthetic polymers. Preferred are multi-filament yarns having a diameter range of about 0.001 to 0.050 inches. Representative of such yarns are multifilaments of polyester, polyamide, polypropylene, polyimide, arcylic, acetate, rayons, modacrylic and glass. The fabric 10 may be woven by conventional weaving techniques, well known to those skilled in the art.

In the precursor fabric 10, the stuffer pick yarns are covered with a coating 20 of an unfoamed, polymeric resin, foam forming composition. The coating thickness is not critical but may be from about 0.001 to 0.040 inches. To prepare a dryer felt fabric of the invention, the fabric 10 is treated to activate the coating 20, forming in-situ a polymeric resin foam, encapsulating the yarns 18 and closing void spaces 16 adjacent to the yarns 18.

Although placement of the foamable composition 20 in the body of the fabric 10 is preferably accomplished by coating the stuffer yarns 18 and weaving the coated yarns into the fabric 10 structure, it will be appreciated that such placement can be accomplished in other ways. For example, polyolefin monofilaments may be fabricated in their entirety from foam-forming thermoplastic compositions and used in place of coated yarns. When foamed in place, the said spaces formerly occupied by the yarn and adjacent areas will be filled with foam.

Figure 2:
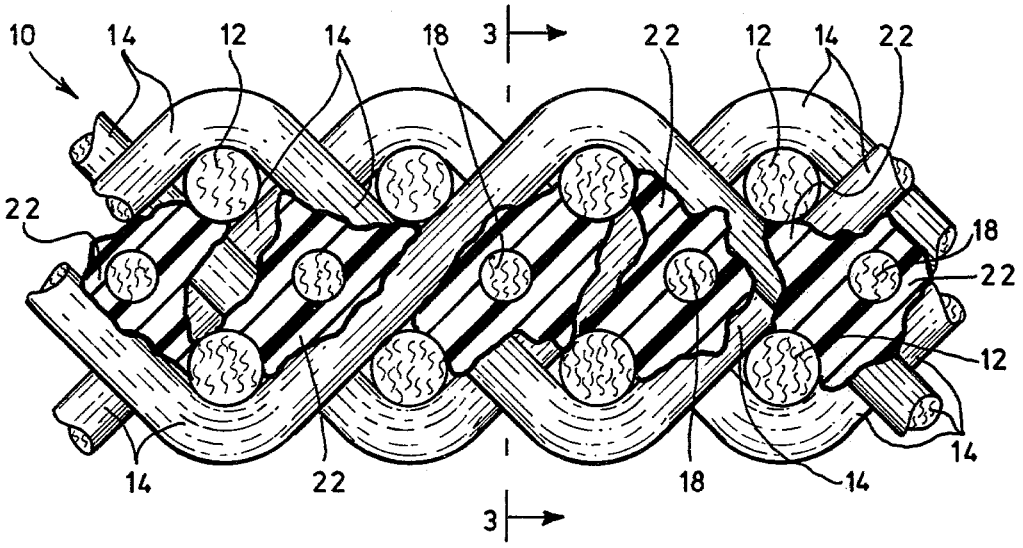
FIG. 2 is a view of the final fabric of the invention prepared from the precursor fabric of FIG. 1, seen in the same view but further enlarged.

Referring now to FIG. 2, there is seen a further enlarged view of the final fabric 10 embodiment of the invention, obtained upon treatment of the fabric 10 to initiate foaming of the coating 20. It will be observed from FIG. 2 that the voids 16 in a 360° zone around the yarns 18 have been filled and the yarns 18 encapsulated by a synthetic polymeric resin foam 22. Thus, the fabric zone between the surfaces of layers A and B is partially closed by yarns 18 and foam 22. This has been found to reduce the permeability of the fabric 10 without affecting other desirable characteristics of the fabric 10 which would detract from its use as a dryer felt fabric.

Figure 3:
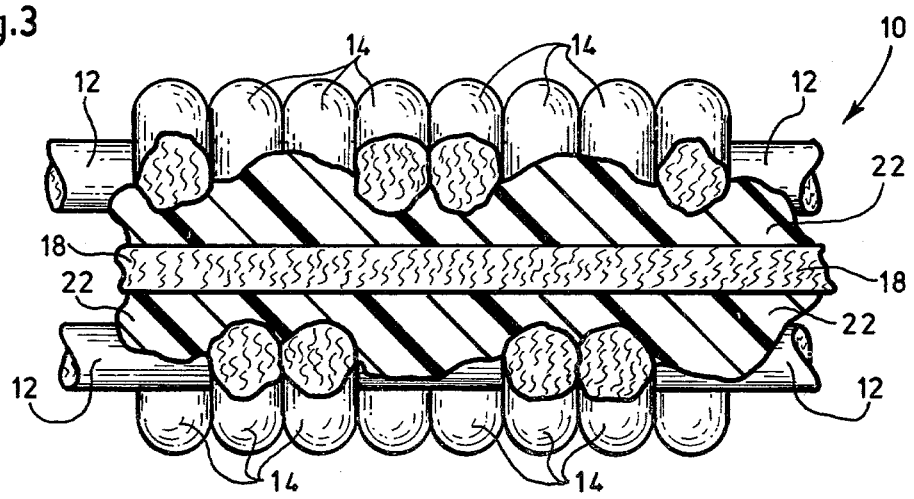
FIG. 3 is a view along lines 3—3 of FIG. 2.

Further structural details of the fabric 10 following foaming of the coating 20 may be seen by referring now to FIG. 3, a view along lines 3—3 of FIG. 2.

Those skilled in the art will appreciate from the above description and from the representations made in FIGS. 2 and 3 that the foam 22 generated around a given stuffer yarn 18 will be fairly localized and, in fact, generally does not extend beyond void areas immediately adjacent to each yarn 18. Thus, an uninterrupted sheet of thermoplastic foam is not formed as a separate layer in the fabric 10. Rather, the foamed areas are localized around the yarns 18 leaving sites of unfoamed areas between adjacent yarns 18. Thus, total permeability of the fabric is not removed in the fabrics 10, as shown in FIGS. 2 and 3. The resin foam 22 may have any degree of flexibility and also serves to bind somewhat the yarns 12, 14 but not so tightly as to destroy flexibility in the final fabric 10. Those skilled in the art will know how to cross-link the resin foam 20 in varying degrees to vary foam flexibility.

It will also be appreciated that one can obtain fabrics of the invention having varied permeabilities by selection of the density of coated yarns 18 which are employed in the construction of the precursor fabric 10. Thus, by providing a higher density of the yarns 18 which are subsequently encapsulated in foam, one can have lower permeability fabrics 10. In contrast, by a lower density of subsequently foamed in place yarns 18, higher permeabilities in the resulting fabrics may be achieved. One can readily determine by trial and error techniques the densities of coated yarns 18 in a given fabric which will yield a given range of fabric permeability. Also by proper spacing of the yarns 18 one can be assured of evenly distributed air permeability from one end of the fabric to the other as finally formed in a dryer felt belt.

The foam forming coat 22 surrounding the yarns 18 may be any synthetic, polymeric, thermoplastic foam forming resin composition. In a preferred embodiment dryer fabric of the invention, the resin coating 20 is one which will form a closed cell foam. Thus, the final foam material will be relatively moisture impermeable and unlike prior art dryer felt screen fabrics employing spun yarn stuffer picks, will not absorb and retain significant quantities of water.

Synthetic, polymeric, thermoplastic foam forming resin compositions which may be coated on to the yarns 18 are well known in the prior art. Representative of such compositions are dispersions of polymer resins such as polyvinyl chloride, polyethylene, polypropylene, natural rubber, butadiene-acrylonitrile rubber, styrene-butadiene copolymers, polyamides, polyesters, polyurethanes and the like in admixture with conventional blowing agents. For higher temperature applications, polycarbonate, polyimide and like polymer resins may be employed. Conventional blowing agents may be characterized as chemical compounds which decompose at known temperatures to generate gaseous product. Preferred blowing agents are those which decompose upon heating to produce nitrogen gas. Nitrogen gas is the preferred blowing gas because of its non-oxidative properties. Representative of such blowing agents are azodicarbonamide, 4,4'-oxybis (benzenesulphon hydrazide), dinitrosopentamethylene tetramine, tris [m-azidosulfonylbenzene] isocyanurate, tris[p-azidosulfonylbenzene] isocyanurate, p-toluenesulfonyl hydrazide, 2,2'-azobisisobutyronitrile and the like.

The proportion of blowing agent may be varied according to known techniques to cause a foam expansion of up to about 10 times the original volume of the foam forming composition.

The gas phase in a cellular polymer is usually distributed in voids or pockets called cells. These cells may be interconnected in a manner such that gas may pass from one to another, in which case this material is termed "open-celled". if the cells are discrete and the gas phase of each is independent of that of the other cells the material is termed "closed-celled". The open cell foams result when the blowing agent is activated or decomposed when the thermoplastic resin is of a relatively low viscosity so that the gaseous phase meets little resistance in forming the interconnections. If the timing of the blowing agent decomposition is such that the resin is of relatively high viscosity when the gaseous phase is formed, interconnections are not so readily made and closed cell foam results. Those skilled in the art appreciate the balance required for making open or closed cell foams and know how to form one or the other. The techniques of preparing blowing agents in polymer resin dispersions is well known; see for example, Goldberg and Bolabanov, Zh.Organ.Kim., 1, (9), 1604–6, (1965) (Russ.). In general, the blowing agent is blended into the polymer material. Blending may be carried out by milling on a conventional rubber mill or by dissolving in a solution of the polymer. Other methods of mixing the blowing agents and polymer resins will be apparent to those skilled in the art. Other additives such as fillers, extenders, stabilizers, surfactants, dyes, plasticizers, fire retardants, cell size control additives and the like may also be used to compound the foam forming resin 20.

Preferred as the coating 20 is a polyvinyl chloride resin having dispersed therein an appropriate blowing agent such as for example p,p-oxybis-(benzenesulfonyl hydrazide). This blowing agent does not start to decompose at less than about 260° F. enabling one to soften the foam forming composition to facilitate coating the yarns 18. A representative formulation for coating 20 is as follows:

| Preparation 1 | |
|---|---|
| Ingredients | Parts by Weight |
| polyvinyl chloride resin | 100 |
| dioctylphthalate plasticizer | 5 to 300 |
| p,p-oxybis(benzenesulfonyl hydrazide) | 0.5 to 50 |
| lead carbonate stabilizer | 1 to 5 |

If desired, up to 100 parts by weight of a clay filler may also be added to the Preparation 1.

As has been set forth above, other thermoplastic materials such as polyethylene and polyamides are satisfactory for the preparation of coating compositions 20. In the case of polyethylene, the same blowing agents and fillers may be used as shown in Preparation 1 above. No plasticizer, however, will be necessary, the necessary degree of plasticity being imparted by the application of heat during the subsequent coating process wherein the coating composition is applied to the yarns 18. Nylon may also be used as a direct substitute for polyvinyl chloride resin in the above preparation 1 with the exception that the stabilizer may be eliminated and a more compatible plasticizer such as N-ethyl o- and p-toluenesulfonamide used in replacement of the dioctylphthalate.

The Preparation 1 above is, of course, a vinyl plastisol. The plastisol may be coated on the yarns 18 by any conventional yarn coating technique. For example, a conventional type of wire coating extruder having an orifice designed to produce a coated yarn of any desired physical dimensions or cross-sectional configuration may be used. This stage of the operation is carried out at a temperature that will, at a minimum, impart the desired plasticity to the plastisol mix and yet, at a maximum will be insufficient to activate the blowing agent that has been incorporated into the plastisol mix. Alternatively, the plastisol composition may be coated on a multi-filament yarn employing a conventional yarn coating machine or by dipping the yarn in a bath of the warmed plastisol.

The extruded, coated yarn 18 may then be employed as yarns to provide the stuffer pick yarns 18. After the fabric is woven, the above described coating composition may be caused to foam by exposure to heat at a temperature of circa 370° F., resulting in the fabric of the invention as shown in the FIGS. 2 and 3.

| Preparation 2 | |
|---|---|
| Ingredients | Parts |
| linear saturated polyester* | 30 |
| phenol blocked toluene diisocyanate* | 0.5 to 1.0 |
| ketone solvent* | 60 |
| 2,2'-azobisisobutyronitrile | 2 to 3 |

*The above indicated three components are commercially available in a pre-mixed composition (BOSTIK 709; Bostik Division, U.S.M. Corp., Middleton, Mass.).

The above Preparation 2 is a viscous solution of a polyurethane foam forming composition, which may be coated on yarn 18 as described above for Preparation 1.

Activation of the polyurethane foam forming composition occurs by applying heat for melting and foaming the coating. Upon heating, the diisocyanate is unblocked and made available for reaction with the polyol to obtain a polyester polyurethane resin. Simultaneously with the reaction, the blowing agent is activated to foam the polyurethane as it cures. Upon cooling, the foam solidifies, entrapping the gas bubbles to make the solid, cellular plastic foam. The coating of Preparation 2 will activate to form the desired polymeric foam by exposure to a temperature of circa 350° F.

Fourdrinier machines and cylinder machines employ as the forming wire fabrics of the screen type, characterized in part by an open weave of relatively fine mesh. It is of course imperative that they be highly permeable to water to permit drainage of water from the paper furnish deposited on the wire. However, in certain uses, for example, in forming light papers like cigarette papers, it may be desirable to lower the water permeability of a given fabric construction. This may be accomplished by the method of the invention by including a proportion of the yarns 18 bearing a foam-forming composition in the fabric structure of a multi-layer forming wire. When foamed in place, some of the void spaces will be filled at least partially with the foam, preferably a closed cell foam to avoid water retention in the forming wire.

Multi-layer wet felts, used in the press section of the papermaking machine can be similarly constructed to control the void volume in the fabric. When the foam formed in-situ is a closed cell foam, the water handling capabilities of the wet felt will be reduced, while an open cell foam will increase the water handling capability of the felt. Thus one may, by the method of the invention control the water handling capability of the felt for specific applications.

Figure 4:
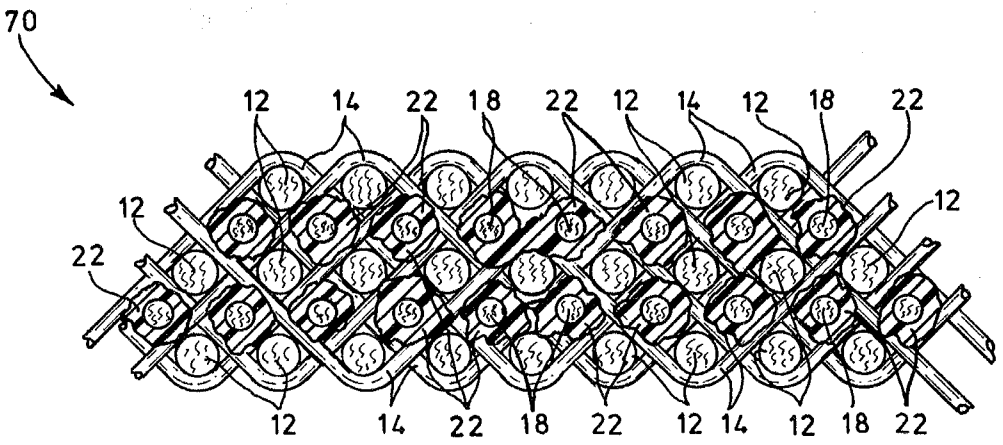
FIG. 4 is an enlarged view of a portion of another embodiment fabric of the invention, seen in a cross-sectional, diagrammatic, side elevation.

It will be appreciated by those skilled in the art that many modifications may be made to the above described preferred embodiments of the invention without departing from the spirit and scope of the invention. For example, referring now to FIG. 4, one can see that a fabric 70 may be woven so as to form multi-layer fabrics including a three and one-half layer embodiment fabric. As shown in FIG. 4, the zones between layers of crosswise yarns 12 have included stuffer pick yarns 18 previously coated with a foam forming resin material, which were then foamed to form in-situ the foamed areas 22. Further, repositioning of a foamable coated yarn as face or back weft yarns would produce a fabric that would have unique characteristics such as a smooth surface, protective surface and/or abrasion resistant surface.

The following examples describe the manner and process for making and using the invention and set forth the best mode contemplated by the inventor of carrying out the invention but is not to be construed as limiting.

Permeability was determined with a Frazier type air permeability tester manufactured by the United States Testing Company. The measurements of this instrument are given in units which refer to the number of cubic feet of air which pass through one square foot of fabric at a pressure corresponding to ½ inch of water (abbreviated, cu. ft./min./sq. ft./at ½" $H_2O$).

DRYER FELT FABRIC

Example 1

There is provided a quantity of 0.016 inch diameter polyester monofilaments which are woven in a duplex pattern, i.e., a multiple system of weft and a single system of warp. Also provided is a quantity of expandable, plastisol coated (coating of Preparation 1, supra.) multifilament of a diameter of 0.028 inches to be used as weft only in the woven fabric.

The density of the monofilament warp in the product is 80 ends to the inch. The number of weft yarns in the product is 29.5 monofilaments and 14.5 coated multifilaments (stuffer yarns) for a total of 44 wefts per inch.

The fabric of the example is finished in a conventional manner, i.e. by heatsetting under tension to offer specific properties of runnability and to activate the blowing agent in the plastisol coated multi-filament yarn, having polyvinyl chloride foam in the interstitial spaces of the fabric adjacent the stuffer yarns.

Upon completion of making the fabric, it is subjected to physical testing and found to have the following physical properties:

Water pick-up: less than 5.2% pick-up after soaking in $H_2O$ for 24 hours.

Permeability: 50 cubic feet of air per minute a ½" $H_2O$ pressure drop

The fabric is of a character useful for making endless and employing as a dryer felt screen on a papermaking machine.

Surprisingly a fabric of this same construction, but containing a spun stuffer yarn (800 grains/100 yds.) instead of the foam-monofilament structure, when subjected to a soaking in $H_2O$ for 24 hours, retained 28% moisture.

What is claimed:

1. A papermaker's fabric, which comprises:
   - a plurality of crosswise yarns disposed in a plurality of separate layers, each layer being on a plane parallel to the crosswise plane of the fabric;
   - a plurality of lengthwise yarns interwoven with the crosswise yarns and binding the layers of crosswise yarns together to form a multi-layer of textile fabric;
   - the crosswise yarns in a given layer being separated from adjacent crosswise yarns in the adjacent layer at points along their length by void spaces within the body of the woven fabric; and
   - a synthetic, polymeric, thermoplastic resin, cellular foam in void spaces.

2. The fabric of claim 1 wherein there is a plurality of stuffer yarns running substantially parallel to the crosswise yarns, between layers of crosswise yarns and partially filling a portion of the void spaces between the layers of crosswise yarns; and the foam is in void spaces surrounding the stuffer yarns.

3. The fabric of claim 1 which is a wet felt fabric.

4. The fabric of claim 1 which is a forming wire.

5. The fabric of claim 1 wherein the resin is polyvinyl chloride.

6. The fabric of claim 1 wherein the crosswise and lengthwise yarns are monofilaments.

7. A dryer felt fabric, which comprises:
   - a plurality of crosswise yarns disposed in a plurality of separate layers, each layer being on a plane parallel to the crosswise plane of the fabric;
   - a plurality of lengthwise yarns interwoven with the crosswise yarns and binding the layers of crosswise yarns together to form a multi-layer textile fabric;
   - the crosswise and lengthwise yarns being synthetic monofilaments and the crosswise yarns in a given layer being separated from adjacent crosswise yarns in the adjacent layer at points along their length by void spaces within the body of the woven fabric;
   - a plurality of stuffer yarns running substantially parallel to the crosswise yarns, between layers of crosswise yarns and partially filling a portion of the void spaces between the layers of crosswise yarns; and
   - a synthetic, polymeric, thermoplastic resin cellular foam closing void spaces adjacent to said stuffer yarn.

8. The fabric of claim 7 wherein the lengthwise and the crosswise yarns are monofilaments and the stuffer yarns are multi-filament yarns.

9. The fabric of claim 8 wherein the resin is polyvinyl chloride.

10. A method of forming a synthetic, polymeric, thermoplastic resin cellular foam within the body of a papermaker's fabric, which comprises;
   - interweaving a plurality of lengthwise yarns with a plurality of crosswise yarns, said plurality of crosswise yarns being disposed in a plurality of separate layers, each layer being on a plane parallel to the crosswise plane of the fabric resulting from said interweaving, whereby said fabric obtained is a multi-layered fabric wherein the crosswise yarns in a given layer are separated from adjacent crosswise yarns in the adjacent layer at points along their length by void spaces within the body of the woven fabric;
   - coating stuffer yarns with a foam forming composition of the resin;
   - weaving the coated yarns into the void spaces of the fabric; and
   - foaming the composition in place in the fabric body.

* * * * *